United States Patent [19]

Korytko

[11] 4,240,778

[45] Dec. 23, 1980

[54] SYSTEM FOR PROVIDING FOR PARALLELISM IN FLUID POWERED PRESS OR THE LIKE

[75] Inventor: Myron I. Korytko, Erie, Pa.

[73] Assignee: Efco, Inc., Erie, Pa.

[21] Appl. No.: 70,011

[22] Filed: Aug. 27, 1979

[51] Int. Cl.[2] ..... B30B 15/16; B30B 15/22; B30B 15/24

[52] U.S. Cl. ..... 425/149; 425/150; 425/214

[58] Field of Search ..... 425/141, 149, 150, 450.1, 425/78, 352, 214

[56] References Cited

U.S. PATENT DOCUMENTS

| | | | |
|---|---|---|---|
| 3,242,533 | 3/1966 | Wintriss | 425/150 X |
| 3,559,247 | 2/1971 | Larsson | 425/149 X |
| 3,570,060 | 3/1971 | Stephenson | 425/149 X |
| 3,640,660 | 2/1972 | DeMets | 425/141 |
| 3,700,765 | 10/1972 | Aoki | 425/450.1 |
| 3,758,245 | 9/1973 | Hermes | 425/150 X |
| 3,860,801 | 1/1975 | Hunkar | 425/149 X |
| 3,881,852 | 5/1975 | Ahrweiler | 425/149 |
| 3,890,413 | 6/1975 | Peterson | 425/149 X |
| 4,000,231 | 12/1976 | Peterson | 425/149 X |
| 4,014,634 | 3/1977 | Hoshino | 425/150 X |

*Primary Examiner*—J. Howard Flint

*Attorney, Agent, or Firm*—Baldwin, Egan, Walling & Fetzer

[57] ABSTRACT

A fluid powered compression molding press or the like in which members such as platen members are movable relatively toward one another to develop high pressures therebetween, such as for instance forming a workpiece or work material in a compression die, and including means for compensating for tilting movement of the movable member relative to the other member by creating a force moment acting on the movable member in a direction opposite to the direction of tilting movement. The compensating means includes leveling units adapted for engaging coaction with the movable member and coupled into a closed fluid system including slave units and a control unit operatively connected together, whereby the control unit operates to generate reaction pressure in the respective leveling unit via the respective of said slave units.

22 Claims, 8 Drawing Figures

SYSTEM FOR PROVIDING FOR PARALLELISM IN FLUID POWERED PRESS OR THE LIKE

This invention relates in general to presses or the like in which a plurality of members, such as platens, are relatively movable towards one another, to develop relatively high pressures therebetween, and more particularly provides a press and associated system which includes means for maintaining parallelism between the relatively movable platens or members, utilizing a fluid system.

BACKGROUND OF THE INVENTION

Various mechanisms are known in the art for attempting to maintain parallelism between relatively movable platens in a compression press or the like, during closing movement of the platens which may mount dies, tooling or the like thereon and operate on a workpiece or work material disposed in the die between the platens. Eccentric loading in such type presses are frequently encountered because of the high pressures developed between the platens as they close on the workpiece or material in the die or mold, and correspondingly eccentric forces are generally developed, resulting in non-parallelism between the platens. Non-parallelism of the platens causes defects in the products produced in the molds or dies, including surface defects, and often results in changes of the flow of the work material in the die or mold cavity. Also depending upon the construction of the press, these eccentric forces can cause damage to certain components of the press as well as causing undue wear on the dies or molds, or breakage thereof.

Most of the known mechanisms with which the applicant is familiar, for maintaining parallelism between the relatively movable platens of a compression press, comprise substantial amounts of electronic controls usually including electronic sensors and the like, for attempting to maintain parallelism between the platens as they close on a die in the press. Opening and closing of a compression press in which platens are not parallel results not only in binding and excessive wear on the dies and on the press, but also the electronic control systems and components thereof are subject to damage and generally require substantial maintenance.

SUMMARY OF THE INVENTION

The present invention provides a press and associated fluid system for maintaining parallelism between relatively movable platens in a compression molding press or the like, and utilizing a hydraulic fluid system, which has greater reliability and is, in general, more economical to install in a press including existing designs of presses, as compared to systems embodying electronic controls.

The press system of the invention includes fluid operated leveling units which are mounted on the press and are adapted for engagement with the movable platen of the compression press, and are operable to apply a force moment thereto acting on the movable platen in a direction opposite to the direction of any tilting movement thereof. Each leveling unit is coupled in fluid transmitting relation to a respective fluid operated slave unit, and the latter are operatively connected to a fluid operated control unit, for applying force from the slave units to the control unit, with the control unit being operable to generate pressures in the leveling units via the slave units, which will oppose any tilting of the movable platen.

Accordingly, an object of the invention is to provide a compression press or the like embodying means for maintaining general parallelism between relatively movable platens or members of the mechanism.

Another object of the invention is to provide a mechanism of the above type in which a fluid system is provided to maintain parallelism between the relatively movable force applying members of a press or the like, and without the necessity of utilizing electronic components for sensing eccentricity between the platens relative to one another.

A still further object of the invention is to provide a press of the above mentioned type wherein the means for compensating for tilting movement of a movable compression member relative to the other member comprises fluid operating piston and cylinder leveling units mounted on one of the platens and responsive to any tilt of the movable platen, with the movable platen being adapted to engage the leveling units at a selective position of the movable platen, and with the system including a series of fluid operating slave units, with each of the slave units being coupled in fluid transmitting relation to a respective of the leveling units, and with a fluid operated control unit operatively coacting with the slave units, for receiving applied force from the slave units, and being so constructed and arranged for causing operation of the control unit upon coaction of the movable platen with the leveling units, with the control unit being operable to generate pressures in the leveling units via the slave units, which oppose tilting of the movable platen.

Another object of the invention is to provide a fluid system which is adapted for installation in a mechanism having relatively movable members adapted to apply pressure to a workpiece disposed in a die or mold therebetween, such as for instance a compression press, and in the event that eccentric loading conditions are encountered, the system provides for maintaining the relatively movable members generally parallel with respect to one another, during movement between the relatively movable members, or can provide, upon actuation of predetermined selector controls, maintaining the members in selected non-parallel relation with one another during repetitious cycles of advance and retract movements of the platens of the press.

Other objects and advantages of the invention will be apparent from the following description taken in conjunction with the accompanying drawings wherein:

DESCRIPTION OF PREFERRED EMBODIMENTS

Figure 1:
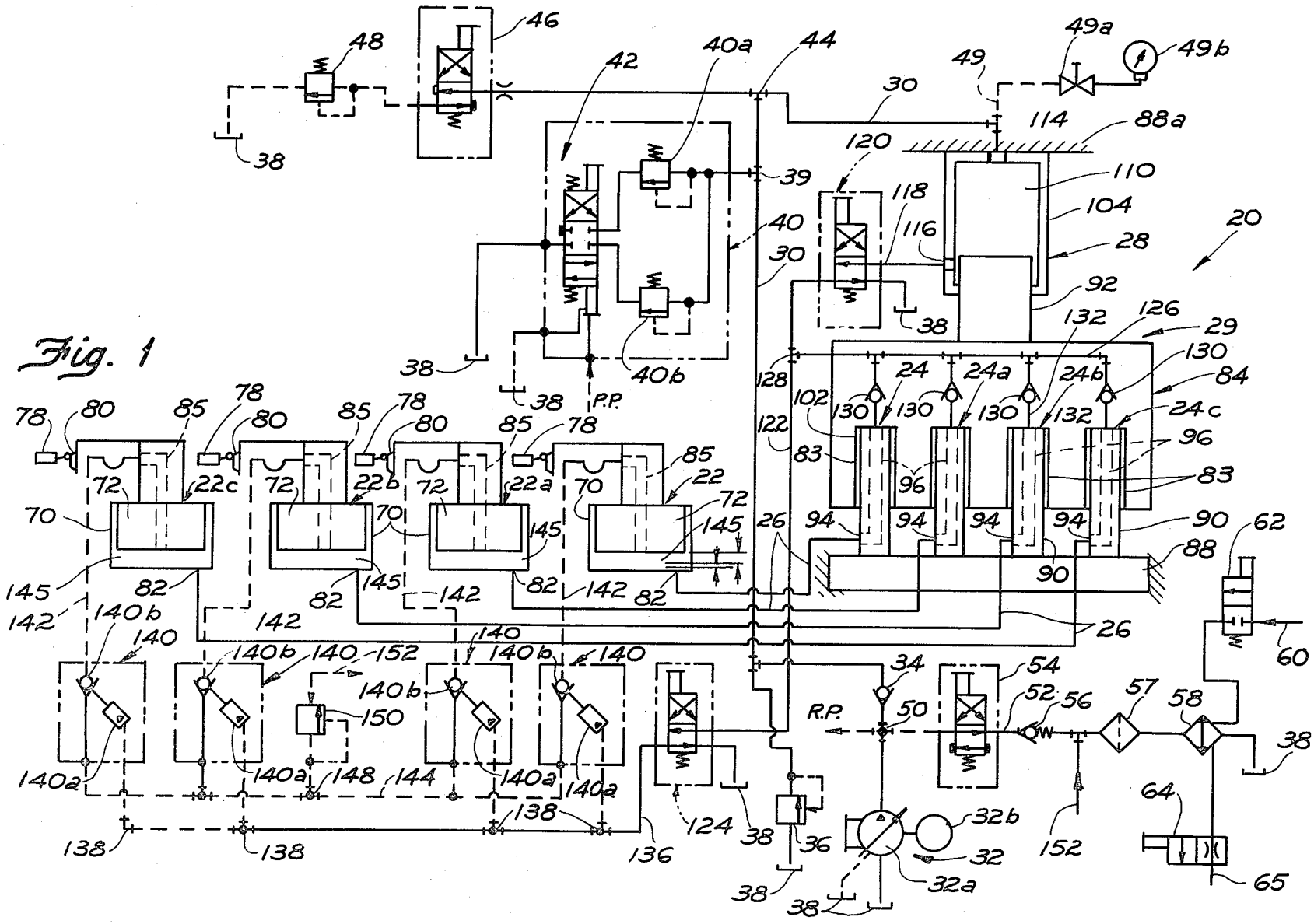
FIG. 1 is a schematic view of the system for controlling and/or maintaining parallelism in the press.
Figure 3:
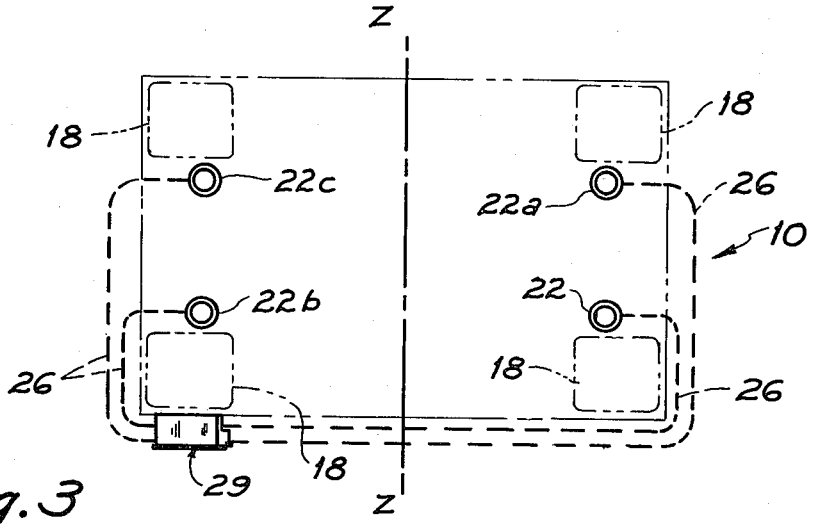
FIG. 3 is a top plan view of the press of FIG. 2.
Figure 2:
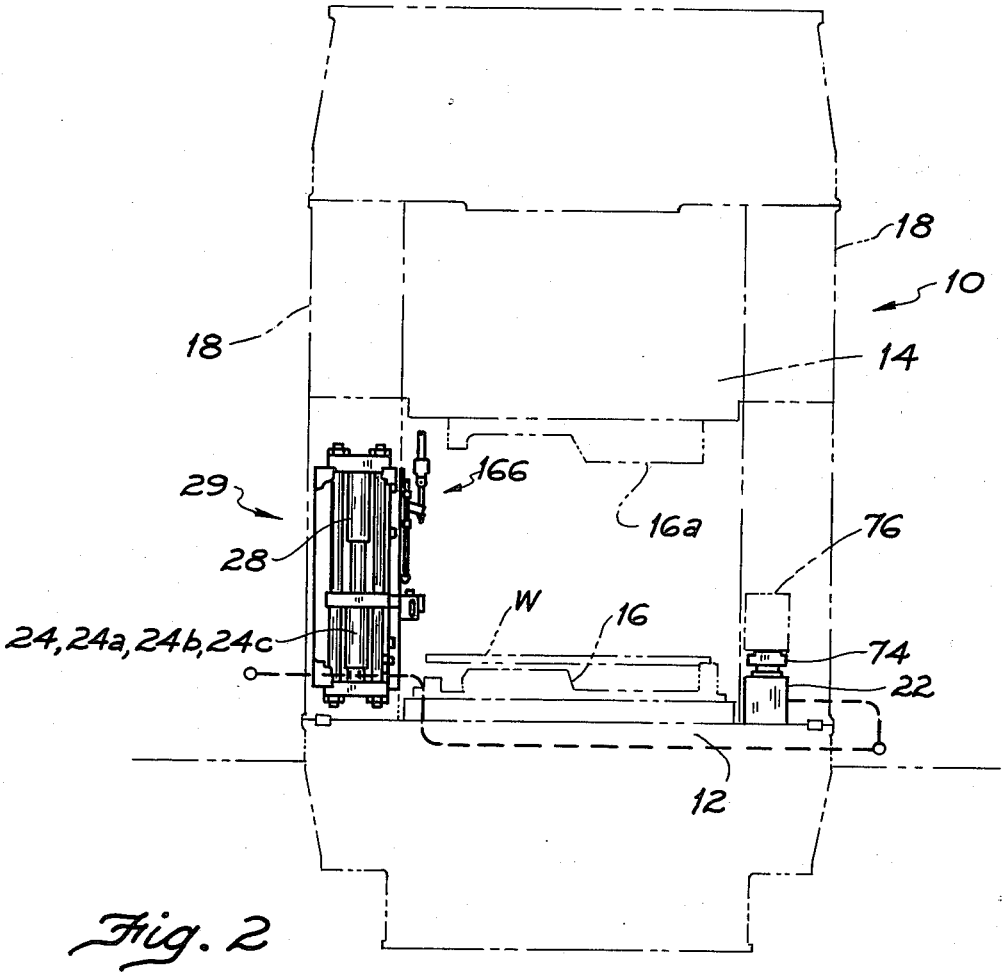
FIG. 2 is a generally diagrammatic side elevational view of a compression press embodying the fluid control system of FIG. 1.

Referring now in particular to FIGS. 1 through 3, there is illustrated the invention as applied to a compression molding press 10 for plastics or the like, having a base platen 12 and a movable platen 14 which in the embodiment illustrated is adapted to be moved vertically to and from the base platen 12 and as by means of conventional fluid operated ram or rams (not shown).

The lower platen 12 may have a lower mold or die section 16 secured thereto, while the upper or relatively movable platen member 14 may have an upper mold or die section 16*a* secured thereto. Upon closing the upper and lower mold or die sections, they are adapted to compression form a workpiece W (such as for instance glass strand reinforced plastic sheet) disposed between the upper and lower die sections. Conventional columns or guides 18 may be utilized in guiding the movement of the upper platen relative to the lower platen, and in the conventional manner. In the embodiment illustrated, the workpiece to be molded is disposed or supported on the lower die section 16.

Normally the upper platen is adapted to move parallel to the lower platen, but when the upper die section compresses the material W being worked upon, and particularly when the workpiece is to be formed into an irregular shape as illustrated, the upper platen may be eccentrically loaded, and may together with the upper die section, be tilted out of parallelism with the lower platen and associated die section 16. Such tiling movement is undersirable as aforementioned, in that it may affect the cross sectional spacing between the upper and lower die members, thereby changing the flow of material in the die cavity and affecting the surface quality of the finish product. Moreover, binding may occur between the coacting die section, causing excessive wear on the dies, as well as on the press itself. These compression presses can generate pressures of 400 foot tons or more and therefore substantial pressures are oftentimes involved, although even in smaller size presses any eccentric forces developed are generally substantial and undesirable, and may result in problems.

The present invention provides a system 20 (FIG. 1) which may be expeditiously embodied in a press or the like, for maintaining parallelism between the relatively movable platen members. Such system in accordance with the invention comprises a fluid system, as opposed for instance to an electronic sensor component system, including a plurality of fluid operated leveling units 22, 22*a*, 22*b*, 22*c* mounted on one of the platens (and in the embodiment illustrated on the lower platen 12) and responsive to any tilt of the movable platen 14 out of parallelism with the lower platen 12, for creating a reaction force moment, to act on the movable platen in a direction to oppose the direction of tilting movement.

System 20 also includes fluid operated slave units 24, 24*a*, 24*b* and 24*c* with each of the slave units being coupled by fluid transmission lines 26, to a respective of the leveling units, and a fluid operated control unit 28 (FIGS. 1 and 4) is assembled with the slave units to form a control unit-slave unit assembly 29 (FIGS. 2, 3 and 4) adapted for mounting on a support, such as for instance a side of one of the columns 18 of the press. Unit 28 operatively coacts with the series of slave units, for receiving applied pressure forces from the slave units, upon engagement of the movable platen 14 with the leveling units. Control unit 28 is operable as will be hereinafter described, to generate reaction pressures in the leveling units via the slave units, which will oppose any tilting movement of the movable platen 14.

As can be best seen in FIG. 1, control unit 28 is coupled via hydraulic fluid transmission line 30 to a source 32 of pressurized hydraulic fluid including low volume pump 32*a* (e.g. 7 gallons per minute) and a power unit 32*b*, such as for instance, an electric motor, operatively coupled to the pump 32*a*. A check valve 34 is provided in line 30 so as to prevent the reverse return of fluid from control unit 28 back to the pump. Also, pressure relief valve 36 connected to tank 38, is provided for limiting the pressure in line 30 to a preselected maximum, which may be, for instance in the embodiment illustrated, 4,000 p.s.i. However, it will be understood that the pressure relief valve 36 can be set at or designed for any desired maximum pressure figure depending upon the pressures desired in the system.

Also, in the embodiment illustrated, coupled into line 30 at juncture coupling 39 is a supplementary relief valve section 40 which includes a low pressure relief valve section 40*a*, and a high pressure relief valve section 40*b*, which in turn are coupled to actuator valve 42, which in the embodiment illustrated is a double acting, four way pilot controlled valve, and which provides for selective control of the flow of fluid via the high and low pressure relief valve sections, to tank 38. The low pressure relief valve section 40*a* may be set for instance, at 1,000 p.s.i. and the high pressure relief valve section 40*b* may be set, for instance to 3,000 p.s.i. so that the pressurized fluid in the control unit 28 could be relieved at these alternate pressures upon selective actuation of actuator valve 42.

Also coupled into fluid supply line 30 at juncture coupling 44 is an actuator valve 46 which in the embodiment illustrated is an electro-responsive valve coupled via back pressure valve 48 to tank 38. Valve 48 can be set any any selected value, but for instance in the embodiment illustrated may be set at approximately 200 p.s.i. This arrangement is for draining the fluid pressure from control unit 28 and transmission line 30 after a preselected amount of movement of the piston of the control unit due to pressurization of the slave units 24, 24*a*, 24*b* and 24*c*, and as will be hereinafter described in greater detail.

Line 30 may also include branch line 49 having a manually operated valve 49*a* embodied therein and coupled to a hydraulic pressure gage 49*b* to indicate the fluid pressure in line 30.

Also coupled into line 30 at juncture coupling 50 below check valve 34 may be branch line 52 which includes in the embodiment illustrated, a solenoid operated actuator valve 54, a check valve 56, a filter 57, and a heat exchanger 58 of conventional known type, for cooling pressurized fluid in line 52. Cooling water is supplied from a source (not shown) coming from line 60 through selector valve 62 into the heat exchanger 58 and then through the water cooling regulator 64 to sump 65.

Figure 8:
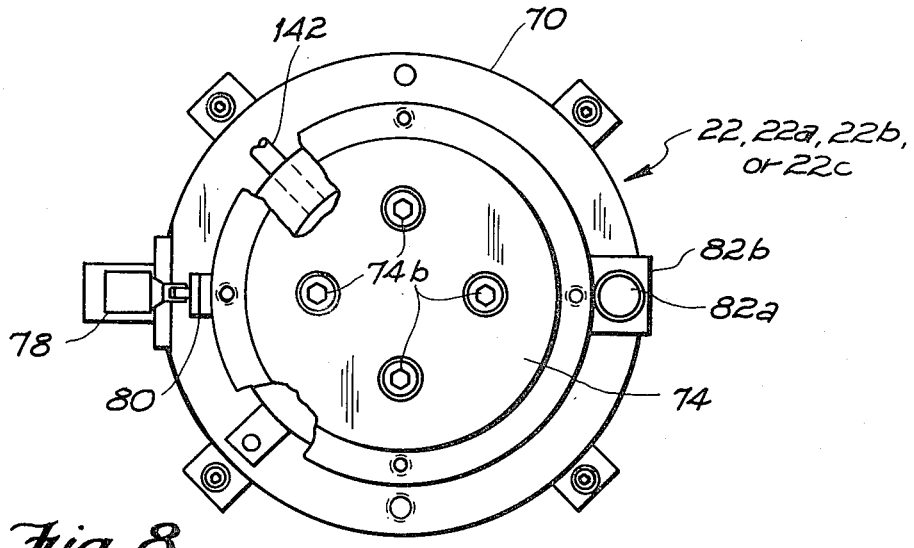
FIG. 8 is a partially broken, top plan view of the FIG. 7 leveling unit.
Figure 7:
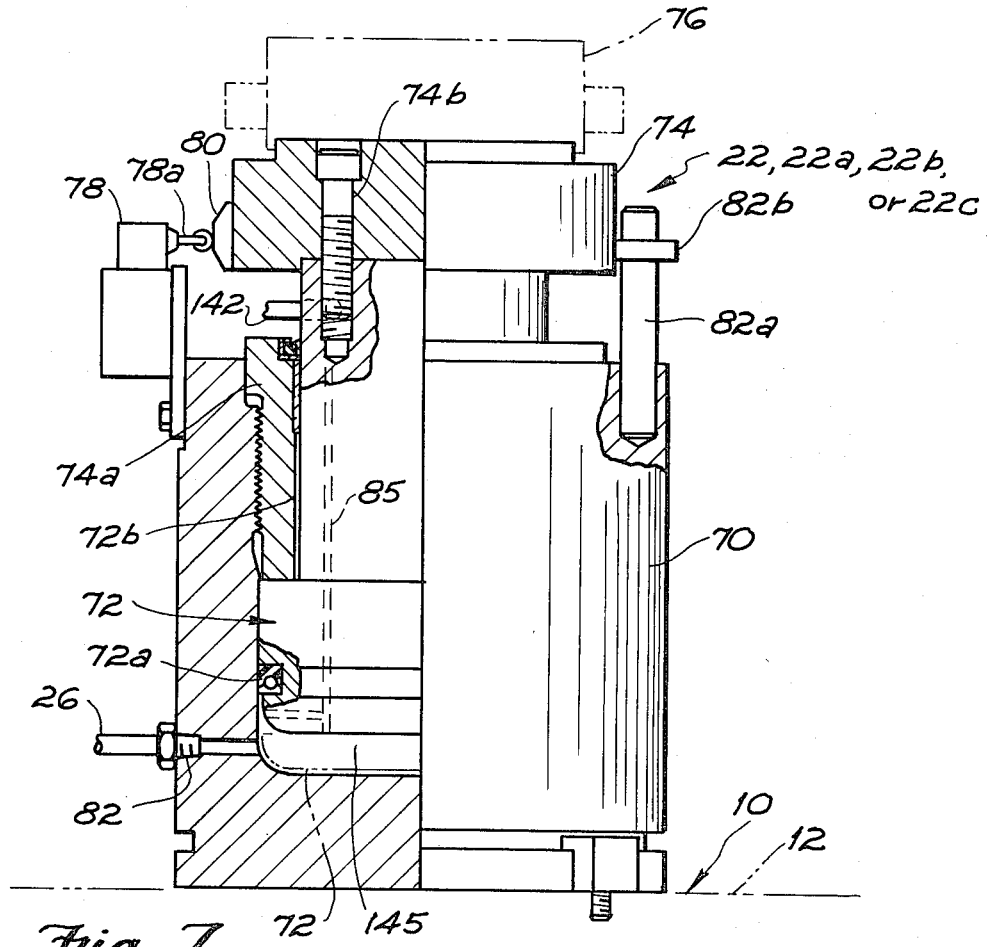
FIG. 7 is an enlarged, partially sectioned, elevational view of one of the leveling piston and cylinder units utilized in the system of FIGS. 1–6.

Referring now to FIGS. 7 and 8, each of the leveling units comprises a cylinder 70 and a piston 72 having sealing means 72*a*, with the piston having approximately, a one inch work stroke, as shown by the phantom line down position in FIG. 7, with an additional approximately one-eight inch overstroke. The piston rod 72*b* is adapted to move in a stuffing box 74*a* mounted in cylinder 70. A cap member 74 is secured as by fastener means 74*b*, to the upper end of the piston rod 72*b*, with the cap member being adapted to support thereon a spacer member 76 (shown in phantom) of whatever size is desired by the customer, to selectively determine at what point the movable platen 14 will engage the leveling units 22, 22*a*, 22*b*, 22*c*. As can be seen in FIG. 7, the spacer is illustrated as being one height while the spacer illustrated in FIG. 2 is of a different or greater height with the spacers being interchangeable as desired by the user of the press, and depending upon the size of dies and of the workpiece W that is to be molded. A full down safety limit switch 78 is preferably mounted on each leveling unit with the switch arm 78*a* thereof being adapted to be tripped at the end of the one inch working stroke of the leveling unit, to relieve the pressure in the press's main pressure system in the event that the full one inch working travel of the piston 72 occurs, so as to prevent damage to the leveling units. As can be seen, the limit switch is adapted to automatically trip upon the predetermined travel of the piston and associated cam 80 mounted on the side of cap 74 of the respective leveling unit. Each of the cylinders 70 of each of the leveling units has a port 82 disposed therein for connection with one of the aforementioned fluid coupling lines 26, which couples each leveling unit to a respective slave unit 24, 24*a*, 24*b* or 24*c* as aforedescribed. Coupling lines 26 are preferably of the same lengths and diameters, so that the amount of fluid in each line 26 is the same.

Pin 82*a* on cylinder 70 coacting with guide bracket 82*b* on cap 74 in relative sliding guided relation, maintains constant the rotational position of the piston 72 relative to the cylinder 70, during axial movement of the piston 72 relative to the cylinder. Passageway 85 may be provided through piston 72 for a purpose to be hereinafter described.

Figure 4:
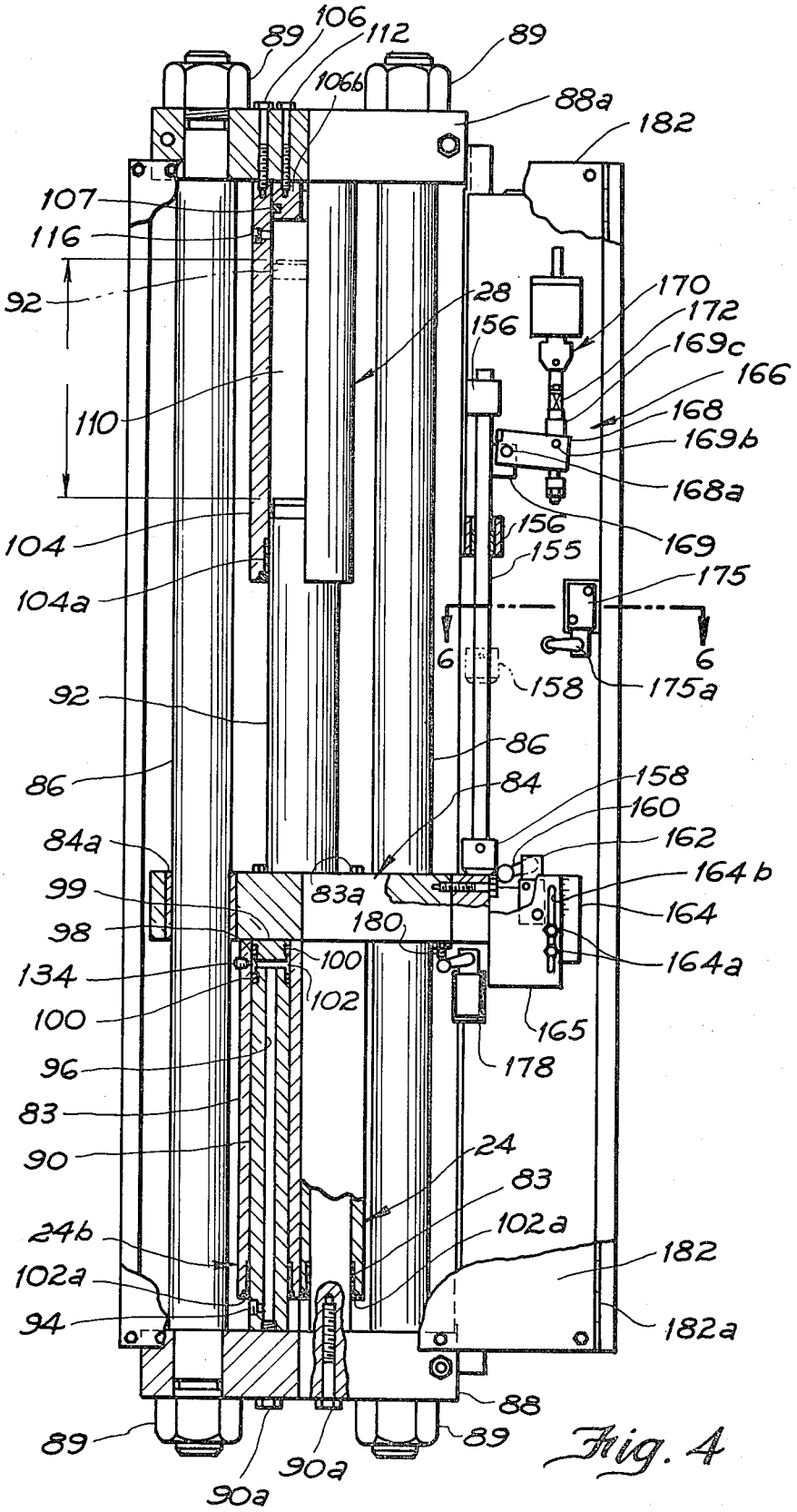
FIG. 4 is an enlarged, side elevational, partially sectional view of the slave units-control unit assembly illustrated on the press in FIGS. 2 and 3.
Figure 5:
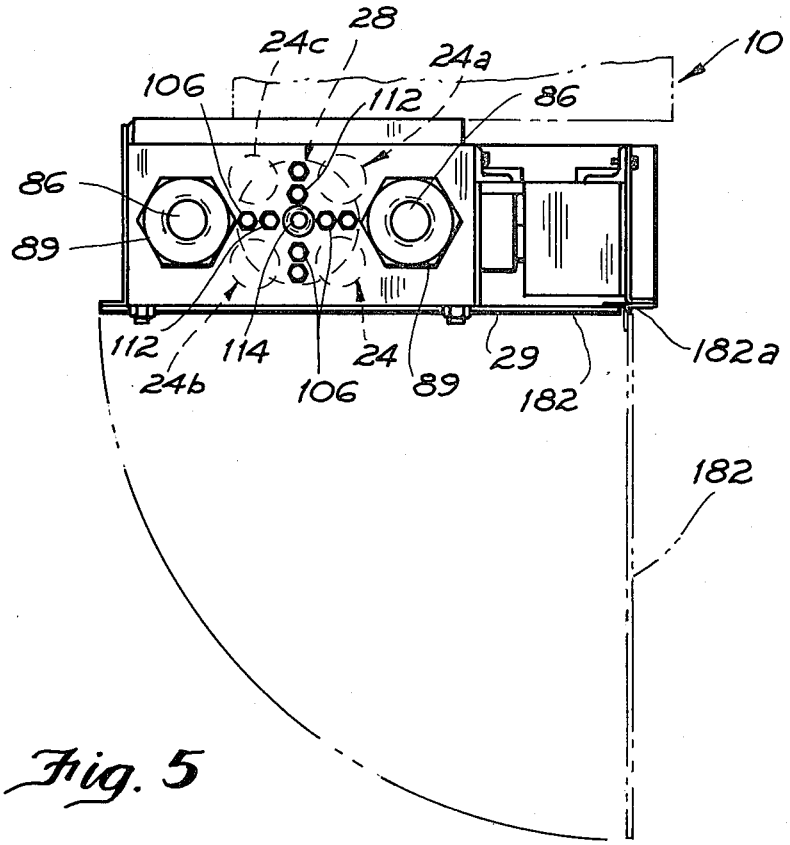
FIG. 5 is a top plan view of the FIG. 4 assembly.

Referring now to FIG. 4, there can be seen a number of the slave piston and cylinder units 24 through 24*c* in the control unit-slave unit assembly 29 mounted, in the embodiment illustrated on the press. Each slave unit comprises a cylinder member 83 secured to the underside of a movable guide cross member 84, as by means of fasteners 83*a*, with the cylinders 83 being spaced generally evenly about the vertical axis of the control unit-slave unit assembly (FIG. 5).

Cross guide 84 may include bushings 84*a* receiving therethrough shouldered tie rods 86, and coacting therewith, which rods are anchored at their ends, to end plates 88, 88*a*, and as by means of nuts 89. Rods 86 guide vertical movement of cross member 84, as will be hereinafter described in greater detail.

Secured to above mentioned bottom end plate 88 is piston 90 of each respective slave unit 24, 24*a*, 24*b*, 24*c*, such pistons being secured as by means of threaded fasteners 90*a*. Pistons 90 and cylinders 83 are preferably disposed generally symmetrically about the lengthwise axis of piston 92 of aforementioned control unit 28, which piston 92 is secured as by means of threaded fasteners (not shown) to the top side of cross guide member 84.

Each of the pistons 90 of the respective slave unit 24, 24*a*, 24*b* or 24*c*, in the embodiment illustrated, comprises an entry port 94, FIGS. 1 and 4, with the entry port being coupled as by means of one of the aforementioned fluid transmission lines 26 to a respective one of the leveling units 22, 22*a*, 22*b* or 22*c*. In the embodiment illustrated, port 94 communicates with a central passageway or bore 96 passing lengthwise through each of the pistons 90, with the passageway 96 opening onto the distal end surface 98 (FIG. 4) of the respective pistion 90. Surface 98 is disposed in confronting relation to the upper head block 99 coupled to and forming the end of the respective cylinder 83.

Seals 100 may be provided for preventing the escape of fluid from each slave cylinder chamber 102, and the guide bushings and wipers 102*a* may be provided on the lower end of the respective slave cylinder. As will be apparent, cylinders 82 of the slave units 24, 24*a*, 24*b* and 24*c*, and piston 92 of the control unit 28 are movable with the cross guide member 84 upon movement of the latter upwardly from the position shown, along the tie rods 86.

The aforementioned pistion 92 of control unit 28 operates in cylinder 104 (FIG. 3) of the control unit, with bushing and wiper 104*a* being preferably provided on the cylinder 104, for coaction with the cylinder side walls. Cylinder 104 may be secured as by means of fasteners 106, to the upper end plate 88*a*, with the cylinder being provided with a head block 106*b*, which may include seal 107, for preventing leakage of fluid from the cylinder chamber 110. Head 106*b* may be secured to the end plate 88*a* by any suitable means such as for instance fasteners 112. Port 114 (FIG. 5) may be provided through the top plate 88*a*, for applying pressurized fluid to chamber 110 via aforementioned fluid transmission line 30 (FIG. 1), port 114 likewise extending through head 106*b* of cylinder 104.

Cylinder 104 may also have a port 116 therein (FIG. 4) communicating with cylinder chamber 110 and connected via fluid transmission line 118 (FIG. 1) to selector valve 120 which in the embodiment illustrated is an electro-responsive pilot operated valve. Valve 120 is connected by means of fluid transmission line 122 to a selector valve 124 (FIG. 1) which again, in the embodiment illustrated, is an electro-responsive pilot operated valve. Branch fluid transmission line 126, connected to line 122 at juncture coupling 128, communicates via check valves 130, with a respective slave cylinder 24, 24*a*, 24*b* or 24*c*, each of which may be connected via a line 132 to cylinder chamber 102 of the respective slave unit 24, 24*a*, 24*b*, or 24*c*. Each of the cylinders 83 of the slave units may also be provided with a bleed port 134 (FIG. 4) which may be manually opened and closed (or automatically open and closed as desired) for bleeding air out of the system.

Selector valve 124 is coupled by fluid transmission line 136 (FIG. 1) which in turn is coupled at juncture couplings 138 to pilot operated bleed-off valves 140, which are used for bleeding off fluid from a respective leveling unit 22, 22*a*, 22*b* or 22*c*, as will be hereinafter described in detail. The fluid powered operator 140*a* of each of the bleed off valves 140 is coupled to a respective check valve 140*b* therein, and when furnished pressurized fluid via actuator valve 124, and line 136, the respective check valve 140*b* will be opened thereby communicating fluid transmission line 142 coupling the respective leveling unit to the check valve 140*b*, with fluid transmission line 144. Upon opening of the respective check valve 140*b* fluid can pass from the cylinder chamber 145 of the respective leveling unit through line 142, through the check valve 140*b* to common line 144 coupling the bleed off valves 140 together.

From line 144 via juncture coupling 148, the fluid can pass through back pressure valve 150. Valve 150 may be pre-set to a maximum maintained pressure of for instance 200 p.s.i. From valve 150 the fluid pressure can pass via line 152 to aforementioned line 52 for passing through the filter 57 and heat exchanger 58 back to tank, check valve 56 preventing back flow of fluid through selector valve 54.

Figure 6:
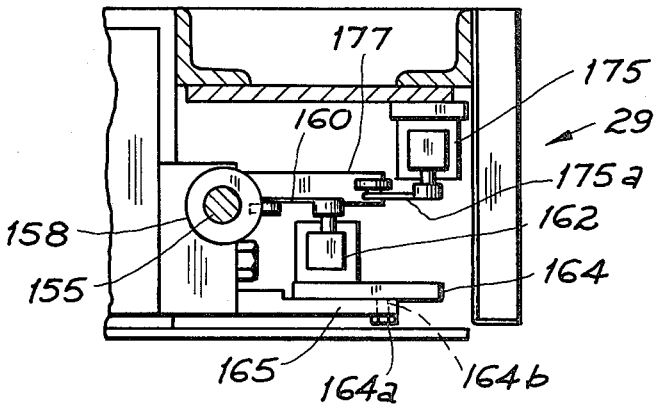
FIG. 6 is an enlarged sectional view taken generally along the plane of line 6—6 of FIG. 4, looking in the direction of the arrows, and illustrates a stroke control means for obtaining repetition of a press cycle stroke.

Referring now again to FIG. 4, there is illustrated a stroke control mechanism for enabling maintenance of parallelism in the press platens to a predetermined position, and then to repeat that position every time within the stroke of the press system. Such repeating mechanism in the embodiment illustrated comprises, a stroke control rod 155 (FIGS. 4 and 6) which is mounted for sliding movement in guides 156 supported by the control-slave unit assembly 29. Rod 155 preferably includes a beveled ended cam 158, on the lower end thereof, which is adapted for coaction with the actuator arm 160 of control limit switch 162. Switch 162 is mounted on an adjustable bracket 164 as by means of fasteners **164*a* coacting in elongated slot 164*b* in support plate 165, thus enabling vertical adjustment of the position of limit switch 162 with respect to plate 165. The rod 155 is adapted to be moved by the cross guide member 84 to a selected position where it is desired that the aforementioned drain valve 46 be opened to tank, limit switch 162 being operable to actuate the solenoid of valve 46** to open the latter.

A braking or locking mechanism 166 is provided for maintaining or holding the rod in whatever position is selected for actuation of switch 162 and thus actuation of valve 46. Such locking mechanism in the embodiment illustrated, comprises a friction shoe 168 pivoted as at **168*a* to a support 169, and pivoted as at 169*b* to a vertically movable linkage 169*c*, which is adapted for actuation by a solenoid actuator 170. Actuation of solenoid actuator 170 against the resistance to compression of spring 172 will cause upward movement of linkage 169*c*, and thus pivoting of the friction shoe 168 into locking frictional engagement with the rod 155, to fix the rod in whatever vertical postion it has been placed. Accordingly, during the next working cycle of the press, and movement of the cross member 84 upwardly from its "down" position illustrated, together with the resultant movement of the piston 92 of the control unit 28 upwardly into the cylinder 104 thereof, causes engagement between the rod cam 158 on the rod 155 (which is locked in selected position by means of locking mechanism 166) with the actuator arm 160 of limit switch 162, to thus cause actuation of the solenoid valve 46 and opening of the control unit to drain, thereby stopping any further upward movement of the cross guide 84 and associated piston 92**, thereby automatically controlling the work stroke during which parallelism is maintained in the press cycle.

There may also be provided what is called a "full down" limit switch 175 (FIG. 4) with the actuator arm **175*a* thereof being adapted for actuation by abutment 177 (FIG. 6) on the cross guide member 84, so that when the main ram on the press 10 has moved the upper platen 14 all the way down for the full working stroke of the press, thereby actuating in full the control unit (i.e. the piston 92 is in the phantom line position shown in FIG. 4) the switch 175 will be actuated to shut down or stop the main ram of the press. Also there may be provided a "full up" limit switch 178 mounted on the control-slave unit assembly 29 and adapted for actuation by means of adjustable actuator 180 on the cross guide member 84, for providing a signal to the press operator that the parallelism system is available to be "charged" or "pumped up" with pressurized fluid when the control unit piston 92 is in fully retracted condition with respect to its cylinders 104 (the full line position illustrated in FIG. 4**).

Control-slave unit 29 preferably is encased in a housing having an access door 182 (FIG. 5) which in the embodiment illustrated is pivoted as at **182*a*** for swinging to open position to provide ready accessibility to the control-slave unit.

Operation of the parallelism maintaining arrangement to counteract eccentric loading of the press, and more particularly the relatively movable platens or members 12 and 14 thereof, may be as follows: The operator may actuate the main ram or rams (not shown) for the press, causing the upper platen 14 to move downwardly, which occurs with the upper and lower platens being in generally parallel relationship with respect to one another, and until the upper platen 14 engages the leveling units 24 through **24*c*, and when the upper die section 16*a* is generally engaged with the lower die section 16 in the compression molding of the work material or workpiece W in the die. In other words, until substantial forces are developed during the compression stroke of the press the platens and associated die sections will generally remain parallel to one another as guided by columns 18 of the press. Thereafter, further downward movement of the upper platen will cause application of substantial compressive forces to the fluid disposed in the operating chambers 145 of the cylinders 70 of the leveling units 22, 22*a*, 22*b* and 22*c***.

Prior to commencing a compression operation, the pump and associated motor **32*a*, 32*b* of pressurized fluid source 32 is actuated, so that pressurized fluid is generated by the low volume pump, such fluid passing through check valve 34 and line 30 into the cylinder chamber 110 of the control unit 28 via port 114, thus "pumping up" the unit and causing the piston 92 thereof to be driven downwardly (with respect to FIG. 4) (and thus moving the cross guide member 84 downwardly therewith) to the full line position of piston 92 illustrated in FIG. 4**.

Also the actuator valve 120 can be operated by the press operator, so as to permit flow of pressurized fluid out port 116 through the valve 120 through line 126 and check valves 130 into the chambers **98*a* of the cylinders 83 of each of the slave units 24, 24*a*, 24*b* and 24*c*. Such pressurized fluid will flow from the slave units through the fluid transmitting lines 26 directly into the leveling units 22, 22*a*, 22*b* and 22*c*, at ports 82, thus moving the pistons of the leveling units 22, 22*a*, 22*b* and 22*c* to their uppermost positions, as shown diagrammatically in FIG. 1 and in full lines in FIG. 7**.

Actuator valve 124 can be actuated to "bleed" the leveling units, thus permitting pressurized fluid (including any air in the units) to pass via lines 142 through the check valves **140*b*, which are actuated to open position by means of the respective operator 140*a*, thus causing the bled fluid to feed out through line 144 and back pressure valve 150 into line 152 and then through filter 57 and heat exchanger 58 (FIG. 1) to tank. Actuator valve 124 can then be closed, to prevent any further passage of fluid from the respective leveling unit by blockage by the respective check valve 140*b*, in the bleed off system 140**.

When the upper platen is lowered sufficiently to engage the leveling units 22, 22*a*, 22*b* and 22*c* which as aforementioned may have equal height spacers 76 secured on the respective tops thereof, as shown in phantom lines in FIG. 8, pressure is applied by the pistons 72 to the hydraulic fluid in the cylinder chambers 145 thereof.

Assume now that the upper die section 16*a* has engaged the work material W and that the upper platen is engaged with the leveling units and eccentric loading of the platens developes, for example, about axis Z—Z in FIG. 2, in a counterclockwise direction. Accordingly, lefthand side of the upper platen 14 moves downwardly more rapidly than the righthand side thereof. The tilting or non-parallelism of the upper platen and associated die section is thus in a counterclockwise direction about axis Z—Z, with respect to FIG. 2 of the drawings, and greater pressure will be exerted for example on the pistons of leveling units 22*b* and 22*c* as compared to the pistons of leveling units 22 and 22*a*. These pressure forces on the leveling units are transmitted through the fluid in the respective fluid transmission line 26, to the respective slave unit 24, 24*a*, 24*b* and 24*c*, and the pressures in the corresponding slave units 24*b* and 24*c* will press against the cross member 84 and associated piston 104 of the operating unit 28, with greater force than that occurring in slave units 24 and 24*a*. Accordingly, the reaction pressures in leveling units 22*b*, 22*c* via respective lines 26, will create a force moment acting on the upper platen in a clockwise direction, thus counteracting the tilting motion of the upper platen in the aforementioned counterclockwise direction. Accordingly, the upper platen will tend to level out with respect to the lower platen, and thus maintain parallelism between the upper and lower platens.

The maximum travel of the pistons of the leveling units as can be seen in FIG. 7 is approximately, in the embodiment illustrated one inch, and if over one inch of travel occurs in one or more of the leveling units, then the aforementioned associated safety switch 78 is tripped to shut down the main actuating ram for the press, and thus prevent damage to the leveling units. A one-eighth inch safety overtravel is preferably provided for the maximum travel range of the pistons 72. If the pressure force generated in the leveling units exceed the pressure force in the operating unit 28, the cross guide member 84 and associated piston 92 of unit 78 will rise, moving upwardly along the tie rods 86, and drive the piston 92 inwardly of the cylinder 104 of the operating unit. If the pressure in the line 30 exceeds that of the value set at the pressure bypass valve 36, (or the pressures set at low or high pressure relief sections 40*a* and 40*b* depending on the actuation of selector valve 42) the excess fluid pressure will be exhausted to tank 38.

The effective working area of the piston 92 of the control unit 28 is slightly greater than the combined working areas of the pistons of the slave units 24 to 24*c*. Also, in the embodiment illustrated, the ratio of the effective working area of the piston 72 of each leveing unit to the working area of the piston 90 of the respective slave unit, is approximately 15 to 1.

With the arrangement illustrated and described, it will be seen it is possible to control the movement of the platens with respect to one another, and maintain parallelism therebetween irrespective of eccentric forces applied to the platens by the compression of the work material between the dies or molds.

It is also possible with the stroke control mechanism 166 to open the control unit 28 up to a predetermined position, and repeat a selected closure position of the control unit 28 during continual cycles of the press, so that the press working cycle can be repeated automatically, without manually actuating to open position the drain valve 46 every time that the press platens close to selected position.

It is also possible with the bleed-off arrangement 140 to lower the platens on the press while the latter are out of parallelism by actuating the selector valve 124 and thus causing actuation of operators 140*a* so as to permit such non-parallelism between the platens to be maintained. Then after closure of the bleeder valve mechanism, the press cycle can be repeated, thus being able to repeat the same non-parallel relationship between the platens, because the leveling units have been adjusted so as to be not in level or parallel relationship with respect to one another, but actually to be out of parallel. Thus the press platens operate as though the platens are in parallel even though in fact they are not in parallel.

From the foregoing discussion and accompanying drawings it will be seen that the invention provides a novel fluid powered compression molding press, or the like, in which platen members are movable relatively toward one another to develope high pressures therebetween, and which includes means for compensating for tilting movement of the movable platen member relative to the other member by creating a force moment acting on the movable member in a direction opposite to the direction of the tilting movement, with the compensating means including leveling units adapted for engaging the movable member and being coupled into a closed fluid system including slave units and a control unit operatively connected together, whereby the control unit operates to generate reaction pressures in the leveling units via said slave units.

The invention also provides a mechanism of the aforementioned type wherein the platens can be disposed in non-parallel relationship and the press cycle can be repeated in that non-parallel relationship, by utilizing a bleeder valve system for selectively bleeding fluid from the leveling units upon application of eccentric forces to the platens, so that the leveling units are intentionally not disposed in parallel relationship with respect to one another during repeated press cycles.

The invention also provides a press of the aforementioned type including stroke control mechanism for the control-slave unit wherein the stroke of the press system with maintenance of parallelism, can be automatically repeated for a selected stroke distance of the press.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. In a fluid powered press, a first platen, a second platen, at least one of said platens being movable along a predetermined axis relative to the other platen, one of said platens adapted to support a workpiece thereon, and means for compensating for tilting movement of the movable platen relative to said other platen by creating a force moment acting on said movable platen in a direction opposite to the direction of said tilting movement, said means comprising a plurality of fluid operated leveling units mounted on one of said platens and responsive to tilt of said movable platen, said movable platen being spaced from said leveling units at the start of the platen movement and adapted to engage said leveling units at a selected position of the movable platen, a series of fluid operated slave units, each of said slave units being coupled in fluid transmitting relation to a respective of said leveling units, and a fluid operated control unit operatively coacting with said slave units, for applying force from said slave units to said control unit, upon said engagement of said movable platen with said leveling units, said control unit being operable to generate pressures in said leveling units via said slave units which will oppose tilting of said movable platen.

2. A press in accordance with claim 1 including a source of pressurized fluid coupled to said control unit for applying predetermined fluid pressure to said control unit.

3. A press in accordance with claim 2 including pressure relief means coacting with said source of pressurized fluid, for limiting the fluid pressure applicable to said control unit to a preselected amount.

4. A press in accordnce with claim 1 including fluid coupling means coacting between said control unit and said slave units including control valve means, for selectively coupling the fluid pressure in said control unit to the fluid pressure in each of said slave units.

5. A press in accordance with claim 1 including check valve means coacting with each of said slave units for preventing the application of fluid pressure from said leveling units to pass from the respective slave unit.

6. A press in accordance with claim 1 including bleed off means coacting with a respective of said leveling units for bleeding off pressurized fluid from the respective leveling unit.

7. A press in accordance with claim 6 including selector valve means coacting with each of said bleed off means for selectively controlling bleed off of fluid pressure from the respective leveling unit.

8. A press in accordance with claim 2 including cooling means coacting with said source of pressurized fluid for cooling the fluid.

9. A press in accordance with claim 1 wherein each of said leveling units comprises a piston and cylinder unit mounted on one of said platens, each of said slave units comprising a piston and cylinder unit mounted on said press, and said control unit comprising a single piston and cylinder unit mounted on said press.

10. A press in accordance with claim 9 wherein the effective working area of said piston of said control unit is slightly greater than the combined effective working areas of said pistons of said slave units.

11. A press in accordance with claim 9 including a movable guide cross member extending transversely of the direction of extension and retraction of said control and said slave units, either said cylinders or said pistons of said slave units being secured to one side of said cross member, each said cylinder or said piston of said control unit being secured to the other side of said cross member for movement therewith, and means guiding the movement of said cross member during movement of said one platen during engagement of the latter with said leveling units.

12. A press in accordance with claim 1 wherein the fluid supply line to said control unit is coupled to an actuator valve which is coupled to tank for draining fluid from said control unit upon actuation of said actuator valve.

13. A press in accordance with claim 11 wherein the fluid supply line to said control unit includes an actuator valve coupled to tank for passing pressurized fluid from said control unit to tank upon predetermined actuation of said actuator valve, and including control means on said cross member adapted to coact with adjustable stroke control means on said press for automatically actuating said actuator valve upon movement of said cross member a predetermined amount due to application of fluid pressure force to said control unit by said slave units, thus providing for continual repetition of a selected press stroke.

14. A press in accordance with claim 13 wherein said actuator valve comprises an electro-responsive valve, said stroke control means comprising a rod having a cam at one end thereof, means for slidably adjusting the position of said rod relative to said cross member, means for locking said rod in selected position, and said control means on said cross member comprising an electrical limit switch operably connected to said electro-responsive valve and adapted to actuate the latter to open the fluid pressure in said control unit to tank upon engagement of said limit switch by said cam.

15. A press in accordance with claim 9 wherein the ratio of the effective working area of each leveling unit to the effective working area of its respective slave unit is approximately 15 to 1.

16. A fluid system adapted for installation in a mechanism such as a compression press, having a plurality of platens, with one platen being movable along a predetermined axis relative to the other platen, one of said platens being adapted to support a die formed workpiece thereon, said system comprising means for compensating for tilting movement of the movable platen relative to the other platen by creating a force movement on the movable platen in a direction opposite to the direction of the tilting movement of the platen, said means comprising a plurality of fluid operating piston and cylinder leveling units adapted for mounting one of said platens and being adapted to be responsive to tilt of the movable platen upon engagement therewith, a series of fluid operated piston and cylinder slave units, means coupling each of said slave units in fluid transmitting relation to a respective one of said leveling units, and a fluid operated piston and cylinder control unit coacting with said slave units and being adapted to be actuated by fluid pressure force from said slave units, with said control unit being operable to generate pressures in said leveling units via said slave units which will oppose tilting of the associated movable platen.

17. A system in accordance with claim 16 including a source of pressurized fluid coupled to said control unit for applying predetermined fluid pressure to the piston and cylinder of said control unit.

18. A system in accordance with claim 17 wherein the fluid supply line to said control unit includes an actuator valve which in turn is coupled to tank via a pressure relief valve, for draining fluid from said control unit upon actuation of said actuator valve.

19. A system in accordance with claim 16 including pressure relief means coacting with said source of pressurized fluid for limiting the fluid pressure able to be applied to said control unit to a preselected amount.

20. A system in accordance with claim 16 including supplementary relief valve mechanism including a high pressure relief valve section and a lower pressure relief valve section, and actuator valve means coupled to said high and low pressure relief sections for selectively opening said sections to tank.

21. A system in accordance with claim 16 including bleed off means coacting with a respective of said leveling units for selectively bleeding off fluid pressure from the respective leveling unit.

22. A system in accordance with claim 21 including selector valve means coacting with each of said bleed off means for selectively controlling bleed off of fluid pressure from the respective leveling unit.

* * * * *